US009132976B2

(12) United States Patent
Fujii

(10) Patent No.: US 9,132,976 B2
(45) Date of Patent: Sep. 15, 2015

(54) PAPER SEPARATING DEVICE AND IMAGE FORMING APPARATUS

(71) Applicant: Kyocera Document Solutions Inc., Osaka (JP)

(72) Inventor: Hirokazu Fujii, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 14/484,615

(22) Filed: Sep. 12, 2014

(65) Prior Publication Data

US 2015/0108708 A1 Apr. 23, 2015

(30) Foreign Application Priority Data

Sep. 12, 2013 (JP) ..... 2013-189760

(51) Int. Cl.

| | |
|---|---|
| ***B65H 29/54*** | (2006.01) |
| ***B65H 3/32*** | (2006.01) |
| ***B65H 3/02*** | (2006.01) |
| ***B65H 3/26*** | (2006.01) |

(52) U.S. Cl.

CPC .. *B65H 3/32* (2013.01); *B65H 3/02* (2013.01); *B65H 3/26* (2013.01)

(58) Field of Classification Search

CPC ..... G03G 15/2085; G03G 15/6532
USPC ..... 399/323, 398, 399; 271/311, 312, 313
See application file for complete search history.

(56) References Cited

U.S. PATENT DOCUMENTS

| | | | | |
|---|---|---|---|---|
| 6,785,503 | B2 * | 8/2004 | Kuo et al. | 399/323 |
| 2001/0016134 | A1 * | 8/2001 | Park | 399/397 |
| 2006/0182478 | A1 * | 8/2006 | Miller et al. | 399/398 |
| 2007/0223975 | A1 * | 9/2007 | Yoshida | 399/323 |
| 2007/0280752 | A1 * | 12/2007 | Uchida | 399/323 |
| 2008/0131177 | A1 * | 6/2008 | Aratachi et al. | 399/323 |

FOREIGN PATENT DOCUMENTS

JP 2012-128196 A 7/2012

* cited by examiner

*Primary Examiner* — Thomas Morrison
(74) *Attorney, Agent, or Firm* — James W. Judge

(57) ABSTRACT

A paper separating device for separating a paper sheet includes a frame member, an image carrier, a securing plate, and two types of assemblies. The two types of assemblies include: a first assembly that includes a separation claw configured to separate the paper sheet from the image carrier, a guiding member configured to guide the paper sheet, and a holder with an engaging portion; and a second assembly that engages the guiding member alone to the holder with the engaging portion without holding the separation claw. The frame member and the securing plate each include an assembly securing portion with an engaged portion to be engaged with the engaging portion of the holder. One of the two types of assemblies is secured to the assembly securing portion disposed at the securing plate while another is secured to the assembly securing portion disposed at the frame member.

9 Claims, 17 Drawing Sheets

PAPER SEPARATING DEVICE AND IMAGE FORMING APPARATUS

INCORPORATION BY REFERENCE

This application is based upon, and claims the benefit of priority from, corresponding Japanese Patent Application No. 2013-189760 filed in the Japan Patent Office on Sep. 12, 2013, the entire contents of which are incorporated herein by reference.

BACKGROUND

Unless otherwise indicated herein, the description in this section is not prior art to the claims in this application and is not admitted to be prior art by inclusion in this section.

A known electrophotographic system image forming apparatus with a photoreceptor drum includes a separating device for separating a paper sheet from a drum circumferential surface. The separating device includes a plurality of separation claws having distal end portions in contact with the circumference surface of the photoreceptor drum. Each separation claw is held by a holder together with a guiding roller for guiding the paper sheet as an assembly. The respective assemblies are arranged at a distance from each other in the axial direction of the photoreceptor drum. In a drum frame that supports the photoreceptor drum, a securing portion for securing each assembly is formed. This securing portion is constituted of a plurality of projecting portions and engaging hole portions formed in the projecting portions. Each assembly is secured to the drum frame such that an engaging claw formed in the holder is engaged with the engaging hole portion formed in the above-described projecting portion.

SUMMARY

A paper separating device for separating a paper sheet according to the disclosure include a frame member, an image carrier, a securing plate, and two types of assemblies. The image carrier is rotatably supported by the frame member and rotatable in abutting contact with a paper sheet. The securing plate is to be removably mounted on the frame member. The two types of assemblies include a first assembly and a second assembly. The first assembly includes: a separation claw configured to separate the paper sheet from the image carrier; a guiding member configured to guide the paper sheet; and a holder with an engaging portion. The holder holds the separation claw and the guiding member. The second assembly that engages the guiding member alone to the holder with the engaging portion without holding the separation claw. The frame member and the securing plate each include an assembly securing portion with an engaged portion to be engaged with the engaging portion of the holder. One of the two types of assemblies is secured to a second assembly securing portion disposed at the securing plate while another is secured to a first assembly securing portion disposed at the frame member.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

DETAILED DESCRIPTION

Figure 1:
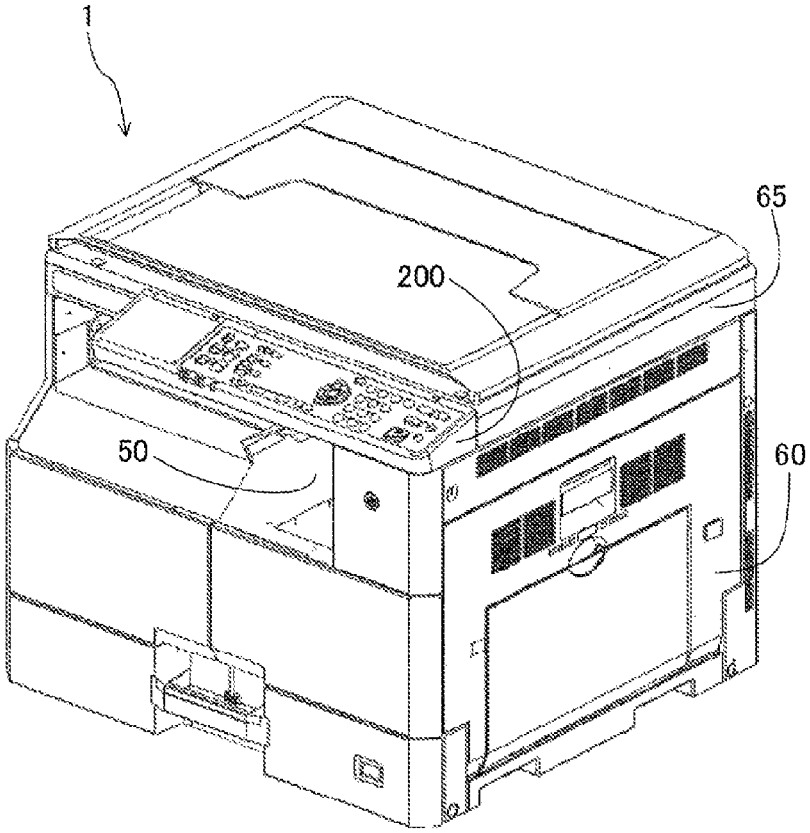
FIG. 1 perspectively illustrates a copier as an image forming apparatus that includes a paper separating device according to a first embodiment.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

Hereafter, a detailed description will be given of embodiments of the disclosure with reference to the drawings. The disclosure will not be limited to the embodiments described below.

First Embodiment

FIG. 1 illustrates a digital copying machine 1 (hereinafter referred to simply as a copier) as an image forming apparatus that includes a paper separating device 31 in this embodiment. This copier 1 includes a main-body housing portion 60 and a scanner housing portion 65 arranged on the upper side of the main-body housing portion 60. The scanner housing portion 65 internally houses a scanner unit 66 (see FIG. 2) for reading a document image. The main-body housing portion 60 internally houses an image forming unit 20 for printing the document image read by the scanner unit 66 on a paper sheet P. On the side surface of the scanner housing portion 65, an operation panel 200 for a user to issue various operation instructions to the copier 1 is located.

Figure 2:
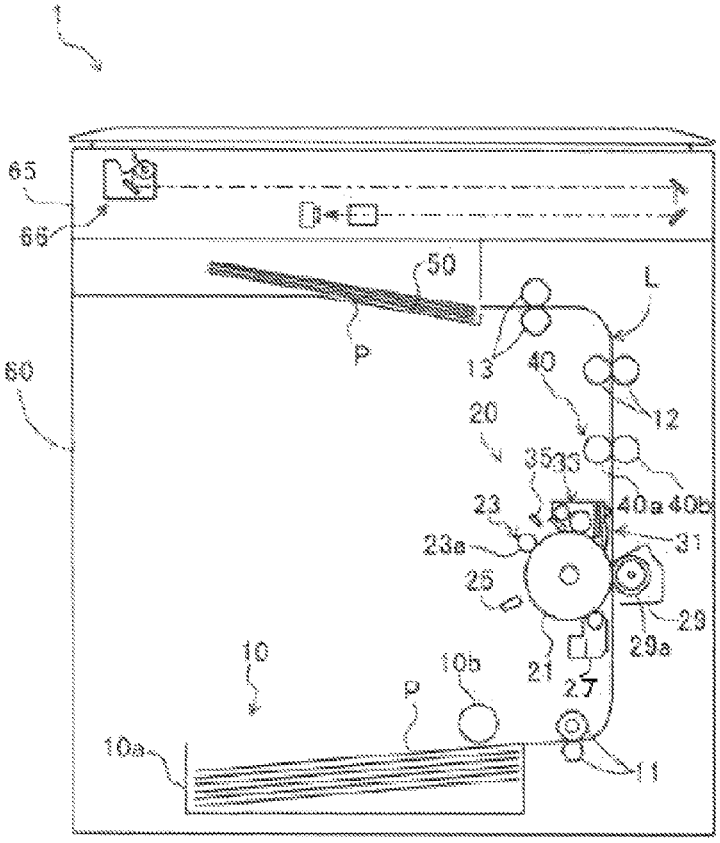
FIG. 2 schematically illustrates an internal structure of the copier according to the first embodiment.

As illustrated in FIG. 2, the main-body housing portion 60 internally houses a paper sheet feeder 10, the image forming unit 20, and a fixing unit 40. In the top surface portion of the main-body housing portion 60, a discharging unit 50 is formed. On a sheet conveying path L from the paper sheet feeder 10 to the discharging unit 50, a plurality of conveyance roller pairs 11 to 13 for sandwiching and conveying the paper sheet P are arranged.

The above-described paper sheet feeder 10 is arranged in the lower portion within the main-body housing portion 60. The paper sheet feeder 10 includes a sheet feed cassette 10*a* and a pickup roller 10*b*. The sheet feed cassette 10*a* houses the sheet-shaped paper sheet P. The pickup roller 10*b* takes out the paper sheet P within the sheet feed cassette 10*a* and sends the paper sheet P to the outside of the cassette. The paper sheet P sent to the outside of cassette from the sheet feed cassette 10*a* is supplied to the image forming unit 20 via the conveyance roller pair 11. In the image forming unit 20, a toner image based on predetermined image data is transferred to the paper sheet P supplied by the paper sheet feeder 10. The paper sheet P is supplied to the fixing unit 40. In the fixing unit 40, the paper sheet P supplied by the image forming unit 20 is pressed between a fixing roller 40*a* and a pressure roller 40*b* to fix the toner image to the paper sheet P. Then, the paper sheet P to which the toner image is fixed by the fixing unit 40 is sent out to the downstream side by both rollers 40*a* and 40*b*. The paper sheet P sent out by the fixing unit 40 is discharged to the above-described discharging unit 50 via the plurality of conveyance roller pairs 12 and 13.

The above-described image forming unit 20 includes a photoreceptor drum 21. In the peripheral area of the photoreceptor drum 21, with reference to the ten o'clock direction, a charger 23, an exposure apparatus 25, a developing unit 27, a transfer unit 29, the paper separating device 31, a cleaning apparatus 33, and a static eliminator 35 are arranged anticlockwise in the drawing in this order.

The above-described charger 23 uniformly charges the circumference surface of the photoreceptor drum 21 via a charging roller 23*a*. The above-described exposure apparatus 25 irradiates a laser beam to the circumference surface of the photoreceptor drum 21 to form an electrostatic latent image corresponding to the predetermined image data.

The above-described developing unit 27 supplies toner to the electrostatic latent image on the circumference surface of the photoreceptor drum 21 for visualization as a toner image. The transfer unit 29 applies a transfer bias to a transfer roller 29*a* to transfer the toner image formed on the circumference surface of the photoreceptor drum 21 to the paper sheet P.

Figure 3:
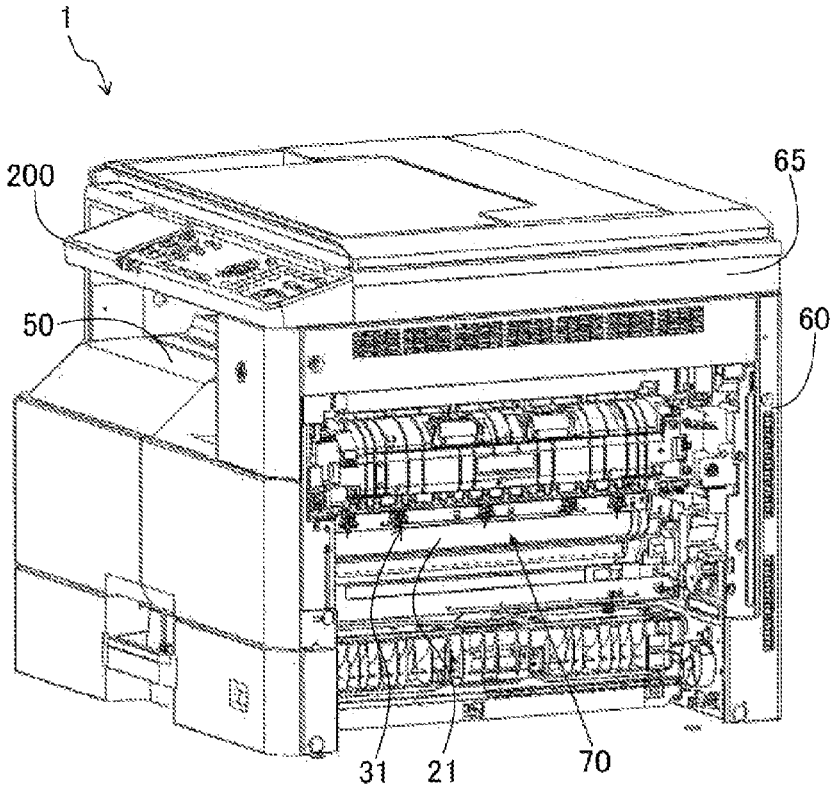
FIG. 3 perspectively illustrates a state where a right-side cover of the copier according to the first embodiment is removed.
Figure 4:
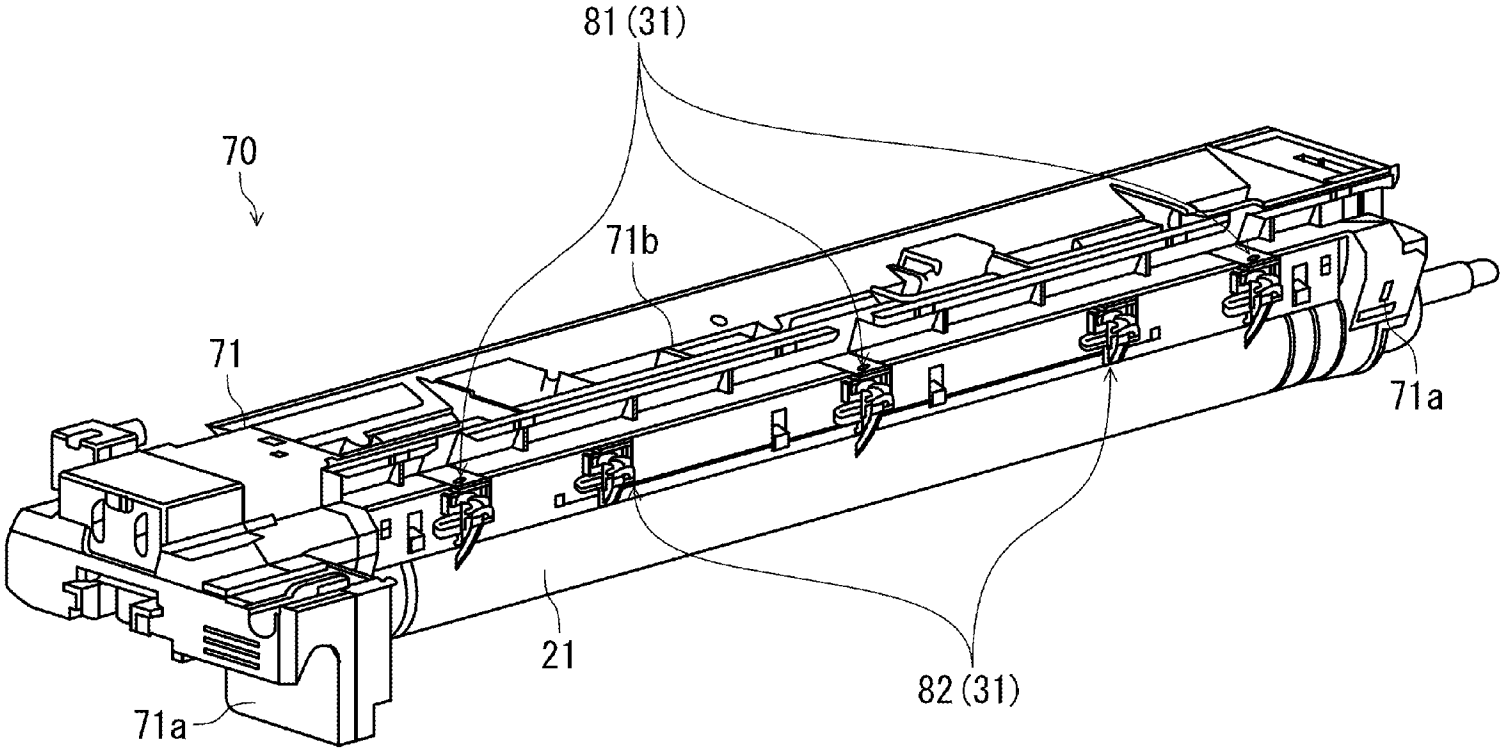
FIG. 4 perspectively illustrates a photoreceptor drum unit according to the first embodiment.

As illustrated in FIG. 3 and FIG. 4, the photoreceptor drum 21, the paper separating device 31, and the cleaning apparatus 33 are unitized via a drum frame 71 so as to constitute a drum unit 70.

The above-described drum frame 71 includes a pair of sidewall portions 71*a* and a cleaning case portion 71*b*. The pair of sidewall portions 71*a* rotatably supports both the end portions of the photoreceptor drum 21 in the axial direction. The cleaning case portion 71*b* is disposed across both the sidewall portions 71*a*. The cleaning case portion 71*b* constitutes the outer wall portion of the cleaning apparatus 33.

Figure 5:
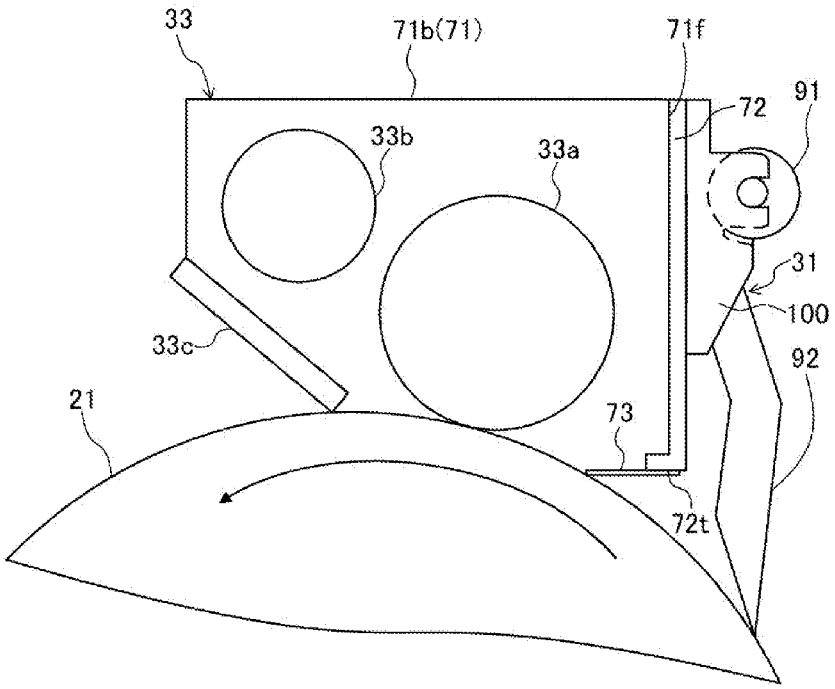
FIG. 5 cross-sectionally illustrates an enlarged outline of a cleaning unit located in a drum frame according to the first embodiment.

As illustrated in FIG. 5, the cleaning apparatus 33 includes a rubbing roller 33*a*, a transport screw 33*b*, and a cleaning blade 33*c*. The rubbing roller 33*a* and the transport screw 33*b* are housed within the cleaning case portion 71*b*. The rubbing roller 33*a* rotates in abutting contact with the photoreceptor drum 21 to scrape off foreign objects such as corona products attached to the circumference surface of the photoreceptor drum 21. The cleaning blade 33*c* is mounted on the downstream end of the cleaning case portion 71*b* in the drum rotation direction. The cleaning blade 33*c* brings its own distal end portion into contact with the circumference surface of the photoreceptor drum 21 to scrape off residual toner attached to the circumference surface of the photoreceptor drum 21. The toner scraped off by the cleaning blade 33*c* is discharged to a toner recovery container (not illustrated) located outside of the cleaning apparatus 33 by the transport screw 33*b*.

In the cleaning case portion 71*b*, the end surface on the upstream side in the drum rotation direction is designed to be a vertical surface in a rectangular shape extending in the axial direction of the photoreceptor drum 21. This end surface on the upstream side constitutes a securing-plate mounting surface 71*f* for mounting a securing plate 72 on the cleaning case portion 71*b* (the drum frame 71). The lower end portion of the securing plate 72 is folded in an L shape toward the inner side of the cleaning case portion 71*b* so as to form a seal mounting portion 72*t*. On the seal mounting portion 72*t*, a film-shaped sealing member 73 is mounted. The sealing member 73 is constituted by, for example, a polyethylene terephthalate (PET) film. The sealing member 73 is formed in a rectangular shape extending in the axial direction of the photoreceptor drum 21. One long-side portion of the sealing member 73 is secured to the seal mounting portion 72*t* while the other long-side portion is in abutting contact with the circumference surface of the photoreceptor drum 21. Thus, the sealing member 73 prevents leakage of the toner within the cleaning case portion 71*b* from the gap between the cleaning case portion 71*b* and the photoreceptor drum 21 to the upstream side of the drum rotation direction.

The above-described paper separating device 31 has a function that separates the paper sheet P from the circumference surface of the photoreceptor drum 21 and guides the paper sheet P to the downstream side in the paper sheet conveyance direction such that the paper sheet P does not flow into the cleaning case portion 71*b*. Specifically, the paper separating device 31 includes a first assembly 81 and a second assembly 82. The first assembly 81 has both a paper separating function and a paper guiding function. The second assembly 82 has the paper guiding function only. Both the assemblies 81 and 82 include common (same) holders 100. In the following description, unless it is explicitly stated otherwise, both the assemblies 81 and 82 are described to be in a state (a state in FIG. 3) assembled to the drum unit 70 within the copier 1.

Figure 6:
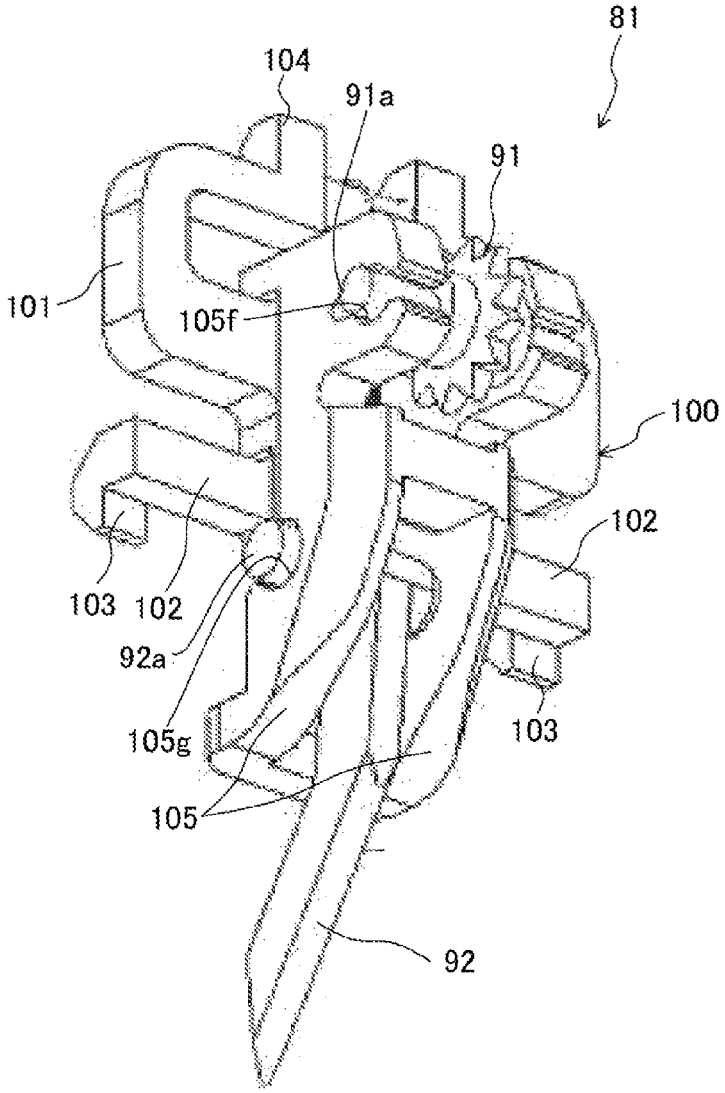
FIG. 6 perspectively illustrates a first assembly according to the first embodiment.

As illustrated in FIG. 6, the first assembly 81 is constituted such that the holder 100 holds a separation claw 92 and a guiding roller 91. The holder 100 includes a holder main body 101, a pair of arm portions 102, a pair of engaging claws 103, a pair of engaging claws 104, and a pair of vertical plate portions 105. The holder main body 101 forms an approximately T-shaped frame. The pair of the arm portions 102 extend from the lower end portion of the holder main body 101 toward both sides of the drum axial direction. The respective arm portions 102 are constituted to be flexible in the up-down direction. The pair of the engaging claws 103 project from the respective distal end portion of the pair of the arm portions 102 to the lower side. The pair of engaging claw 104 projects from the upper end portion of the holder main body 101 to the upper side.

The above-described pair of vertical plate portions 105 is secured to one side in the thickness direction of the holder main body 101. Both the vertical plate portions 105 are arranged at a distance from each other in the drum axial direction. In the upper end portion of each vertical plate portion 105, a first bearing hole portion 105*f* passing through in the drum axial direction is formed. This first bearing hole portion 105*f* is rotatably fitted with a support shaft 91*a* of the guiding roller 91. In the intermediate portion in the up-down direction of each of the vertical plate portions 105, a second bearing hole portion 105*g* is formed. This second bearing hole portion 105*g* is rotatably fitted with a support shaft 92*a* of the separation claw 92.

The circumference surface of the guiding roller 91 has a saw-teeth shape where depressed portions and protruding portions are alternately arranged in the circumferential direction. This reduces the contacted area between the guiding roller 91 and the paper sheet P as much as possible, thus reducing attachment of toner to the guiding roller 91 before the toner is thermally fixed to the paper sheet P.

The separation claw 92 is biased around the support shaft 92*a* by a biasing member (not illustrated) such that the distal end portion of the separation claw 92 is brought into pressure contact with the circumference surface of the photoreceptor drum 21.

Figure 7:
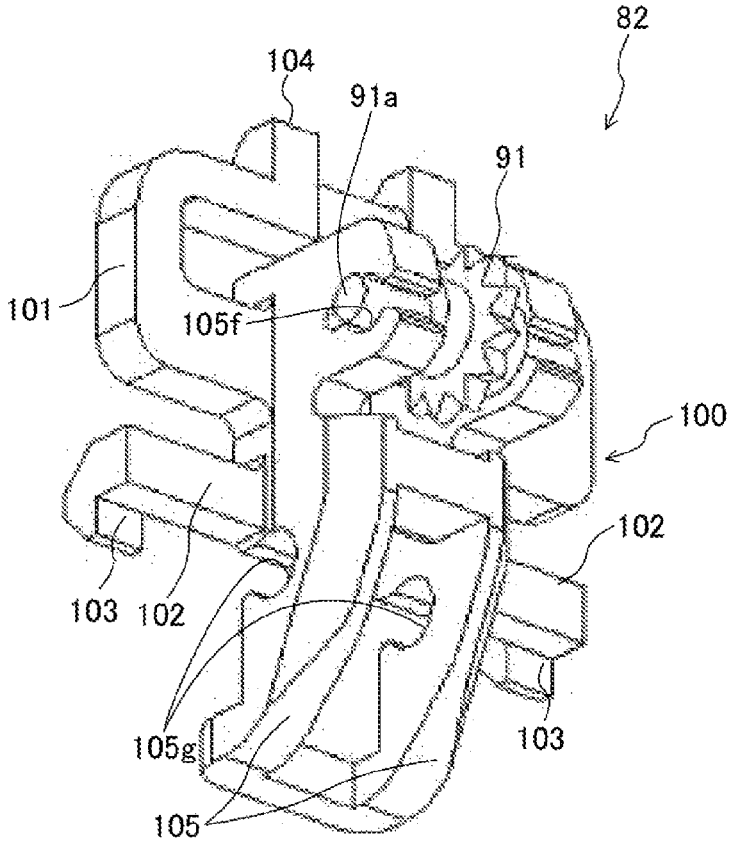
FIG. 7 perspectively illustrates a second assembly according to the first embodiment.

As illustrated in FIG. 7, the second assembly 82 is constituted such that the holder 100 holds the guiding roller 91 alone. The second assembly 82 has the configuration where the holder 100 does not hold the separation claw 92. The configuration is otherwise similar to that of the above-described first assembly 81. Therefore, the detailed description of the second assembly 82 is omitted.

Figure 8:
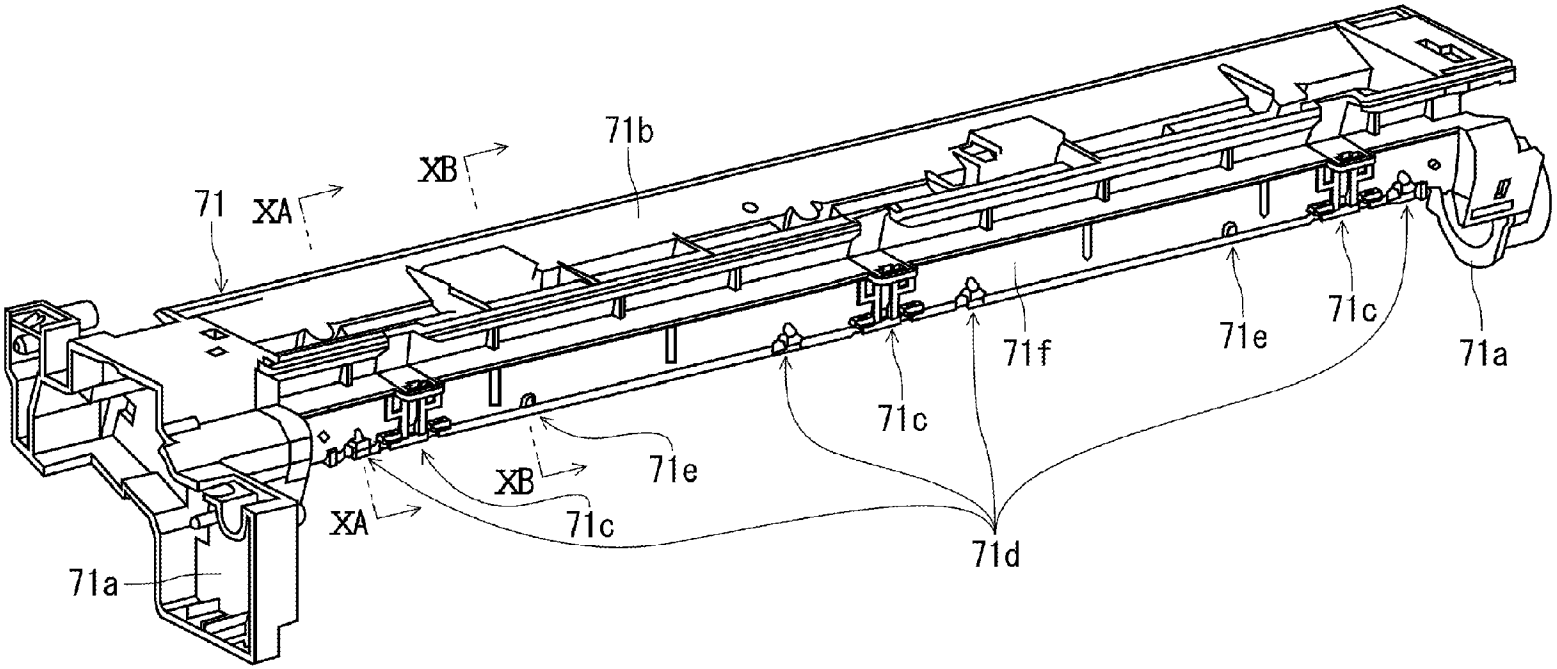
FIG. 8 perspectively illustrates the drum frame according to the first embodiment.

As illustrated in FIG. 8, on the securing-plate mounting surface 71*f* of the drum frame 71 (the cleaning case portion 71*b*), a first securing-plate latching portion 71*d*, a second securing-plate latching portion 71*e*, and a first-assembly securing portion 71*c* are formed. Four of the above-described first securing-plate latching portions 71*d* are formed in total, and are formed at a distance from one another in the drum axial direction. Three of the first-assembly securing portions 71*c* are formed in total, and are formed one by one between the respective securing-plate latching portions 71*d*. Two of the above-described second securing-plate latching portions 71*e* are formed in total, and are formed one by one on both sides of the first-assembly securing portion 71*c* sandwiched in the center.

Figure 9:
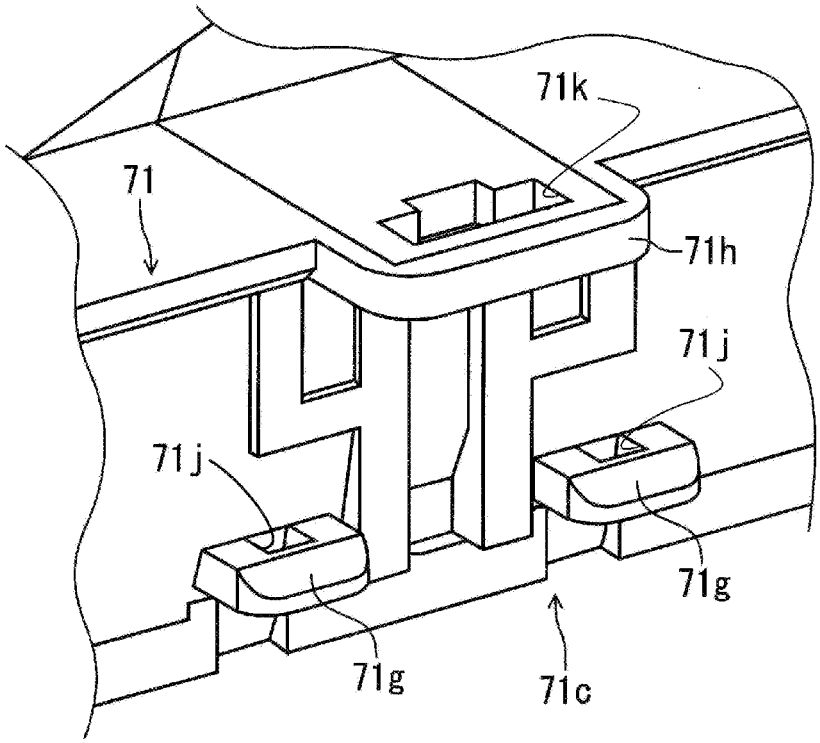
FIG. 9 perspectively illustrates an enlarged first-assembly securing portion formed in the drum frame according to the first embodiment.

As illustrated in FIG. 9, the first-assembly securing portions 71*c* each include a pair of frame-side first projecting portions 71*g* and a frame-side second projecting portion 71*h*. The above-described pair of the frame-side first projecting portions 71*g* are formed in rectangular block shapes extending in the drum axial direction. Both the frame-side first projecting portions 71*g* are formed at a distance from each other in the drum axial direction. In each of the frame-side first projecting portions 71*g*, a frame-side first engaging hole 71*j* passing through in the thickness direction (the up-down direction) is formed.

The above-described frame-side second projecting portion 71*h* is arranged at a distance from the frame-side first projecting portions 71*g* at the upper side. The frame-side second projecting portion 71*h* is arranged across both the frame-side first projecting portions 71*g* viewed from the upper side. The frame-side second projecting portion 71*h* is formed in a rectangular block shape extending in the drum axial direction. In the frame-side second projecting portion 71*h*, a frame-side second engaging hole 71*k* passing through in the thickness direction (the up-down direction) is formed. To the first-assembly securing portion 71*c* constituted as described above, the above-described first assembly 81 is assembled and secured as described later.

Figure 10A:
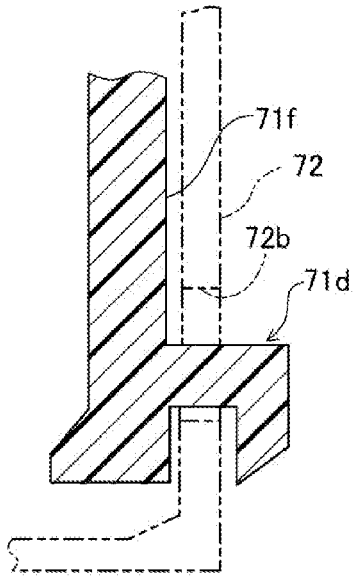
FIG. 10A illustrates a cross section taken along the line XA-XA in FIG. 8.
Figure 10B:
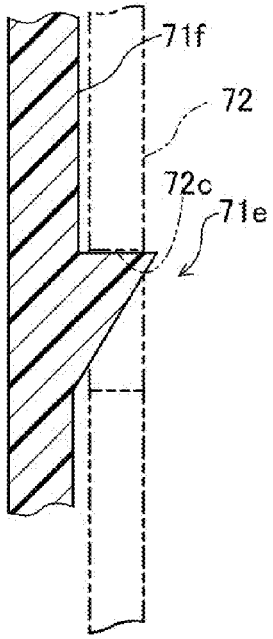
FIG. 10B illustrates a cross section taken along the line XB-XB in FIG. 8.

As illustrated in FIG. 10A, the above-described first securing-plate latching portion 71*d* is formed with a U-shaped cross section opening downward. The peripheral edge portion of a first mounting hole 72*b* formed in the securing plate 72 gets into a U-shaped groove of this first securing-plate latching portion 71*d* to regulate the movement of the securing plate 72 in the lateral direction of the drawing. As illustrated in FIG. 10B, the second securing-plate latching portion 71*e* is constituted by a columnar body in a rectangular triangle shape viewed from the drum axial direction. This second securing-plate latching portion 71*e* fits into the second mounting hole 72*c* formed in the securing plate 72 to regulate the movement in the up-down direction of the securing plate 72. Thus, the securing plate 72 is removably mounted on the securing-plate mounting surface 71*f* via the first and second securing-plate latching portions 71*d* and 71*e*.

Figure 11:
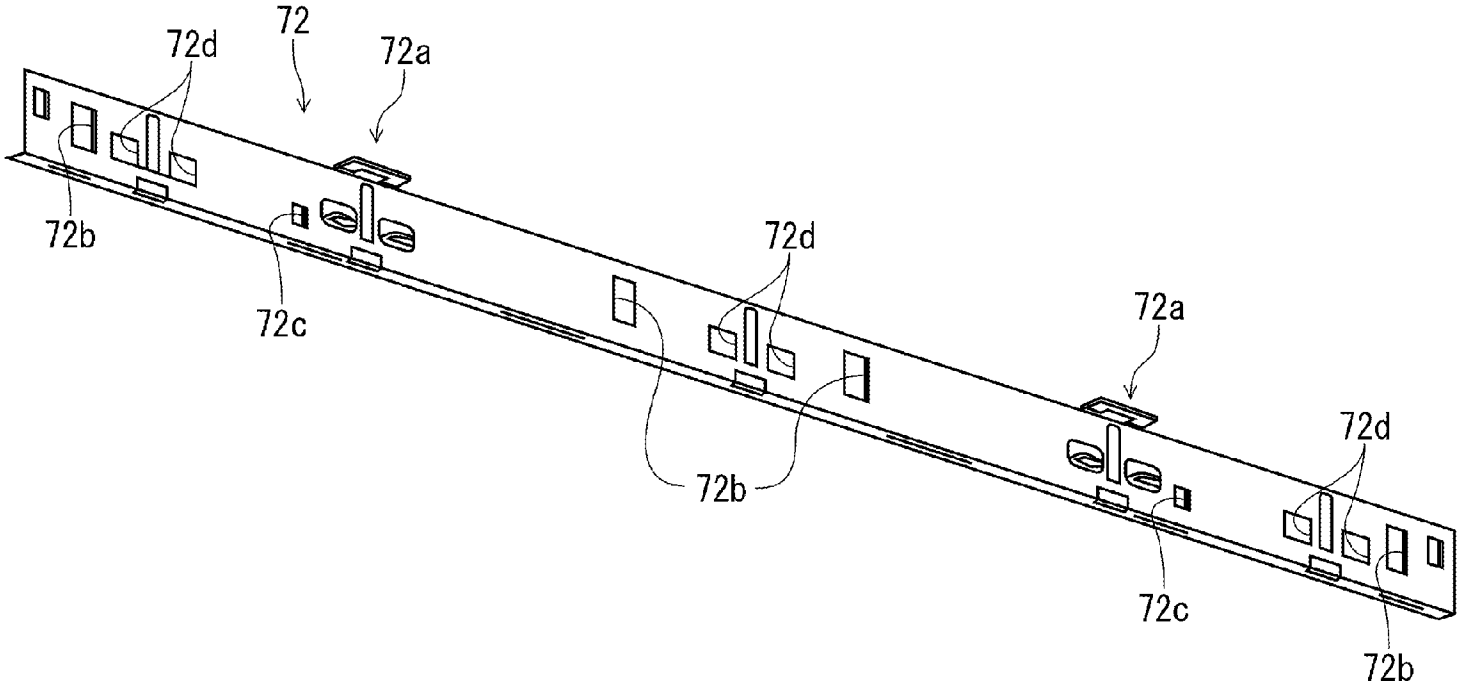
FIG. 11 perspectively illustrates a securing plate according to the first embodiment.

As illustrated in FIG. 11, the securing plate 72 includes pairs of insertion holes 72*d* and second-assembly securing portions 72*a*. Three pairs of insertion holes 72*d* are formed in total, and arranged at regular intervals from one another in the drum axial direction. Two of the second-assembly securing portions 72*a* are formed in total, and are formed one by one between the three pairs of insertion holes 72*d*. In the lateral direction of the second-assembly securing portions 72*a*, the respective above-described second mounting holes 72*c* are formed. Four of the above-described first mounting holes 72*b* are formed in total, and are arranged at regular intervals from one another in the drum axial direction.

Figure 12:
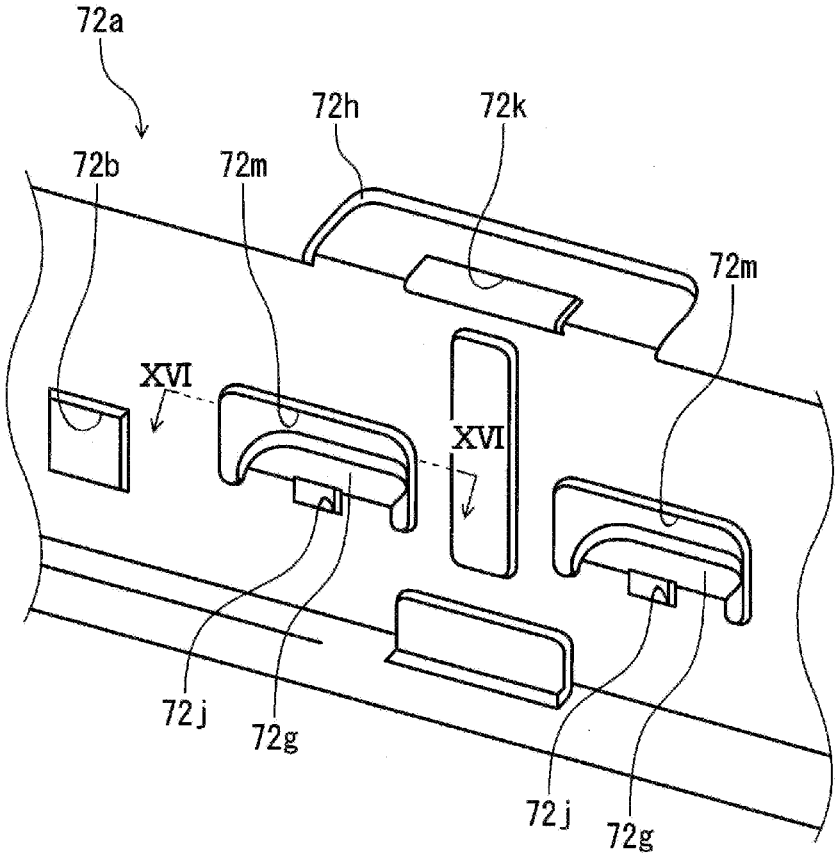
FIG. 12 perspectively illustrates an enlarged second-assembly securing portion formed in the securing plate according to the first embodiment.
Figure 16:
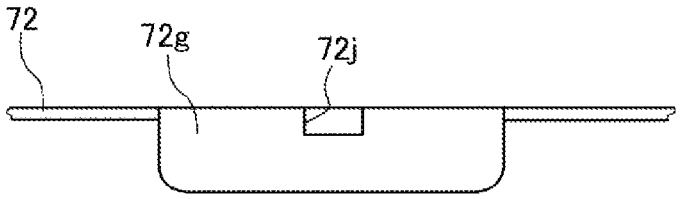
FIG. 16 illustrates a cross section taken along the line XVI-XVI in FIG. 12.

As illustrated in FIG. 12, the second-assembly securing portion 72*a* includes a pair of securing-plate-side first projecting portions 72*g* and a securing-plate-side second projecting portion 72*h*. The above-described pair of the securing-plate-side first projecting portions 72*g* are formed by plate-shaped pieces extending in the drum axial direction, and are arranged at a distance from each other in the drum axial direction. Each of the securing-plate-side first projecting portions 72*g* is formed by cutting out and folding a part of the securing plate 72. In the securing plate 72, this cutout region is formed as a pair of through-holes 72*m*. In the base end portion of the securing-plate-side first projecting portion 72*g*, a securing-plate-side first engaging hole 72*j* (see FIG. 16) is formed.

The above-described securing-plate-side second projecting portion 72*h* is arranged at a distance from the above-described securing-plate-side first projecting portions 72*g* at the upper side. The securing-plate-side second projecting portion 72*h* is arranged across both the securing-plate-side first projecting portions 72*g* viewed from the upper side. The securing-plate-side second projecting portion 72*h* has a rectangular plate shape extending in the drum axial direction. The securing-plate-side second projecting portion 72*h* is formed by folding the upper end portion of the securing plate 72. In the securing-plate-side second projecting portion 72*h*, a securing-plate-side second engaging hole 72*k* passing through in the thickness direction (the up-down direction) is formed. To the second-assembly securing portion 72*a* constituted as described above, the above-described second assembly 82 is assembled and secured as described later.

Figure 13:
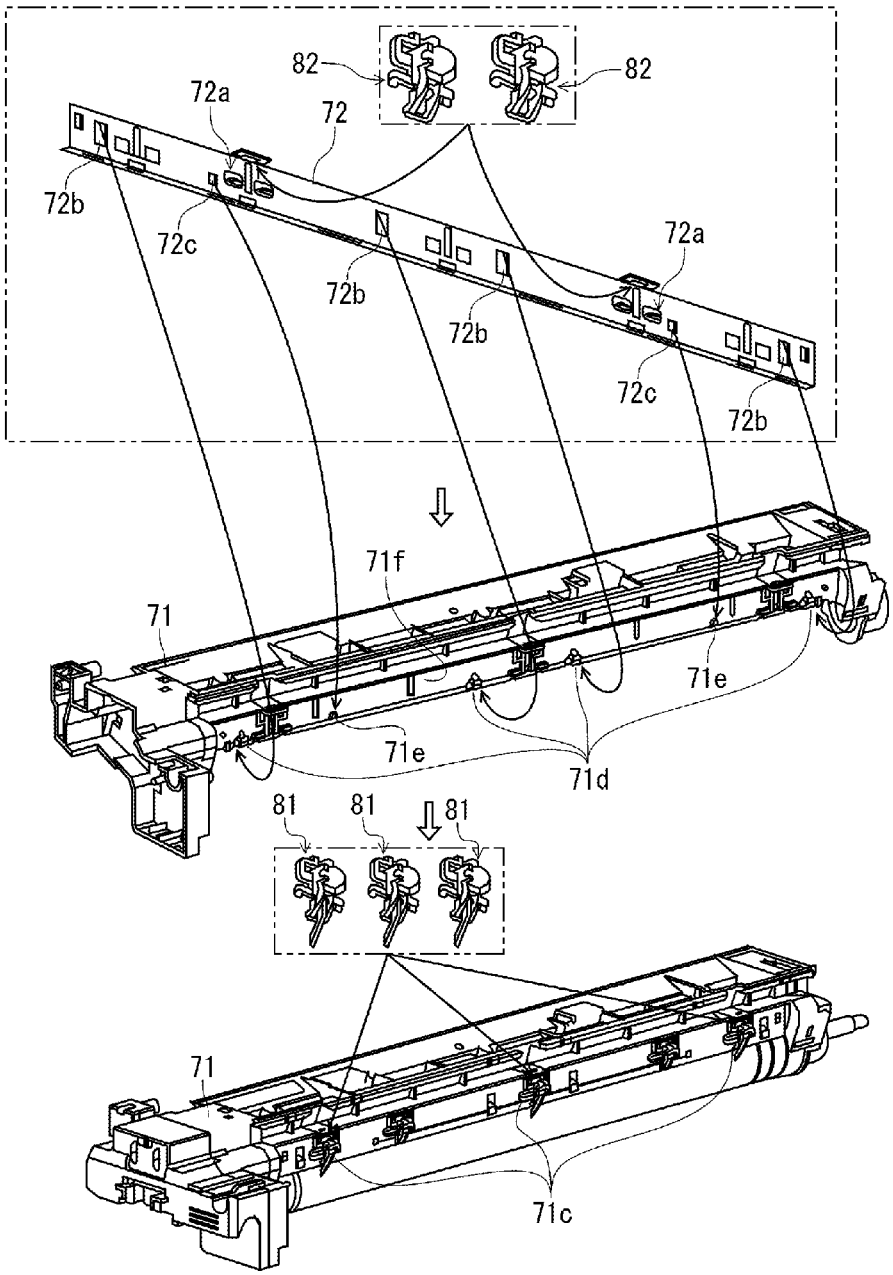
FIG. 13 describes an assembly procedure of the first and second assemblies to the drum frame according to the first embodiment.
Figure 14:
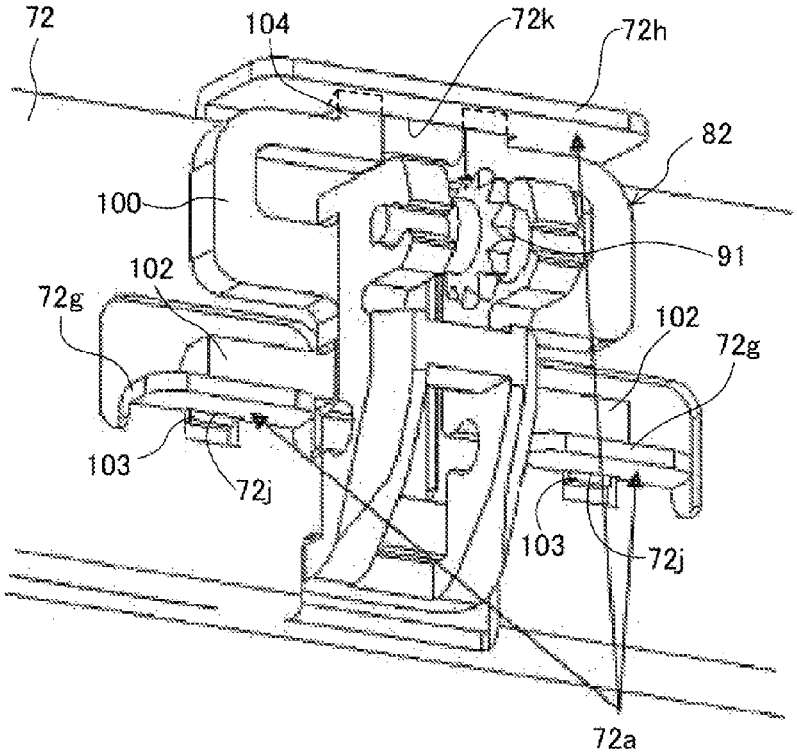
FIG. 14 perspectively illustrates a state where the second assembly is assembled to the second-assembly securing portion formed in the securing plate according to the first embodiment.
Figure 15:
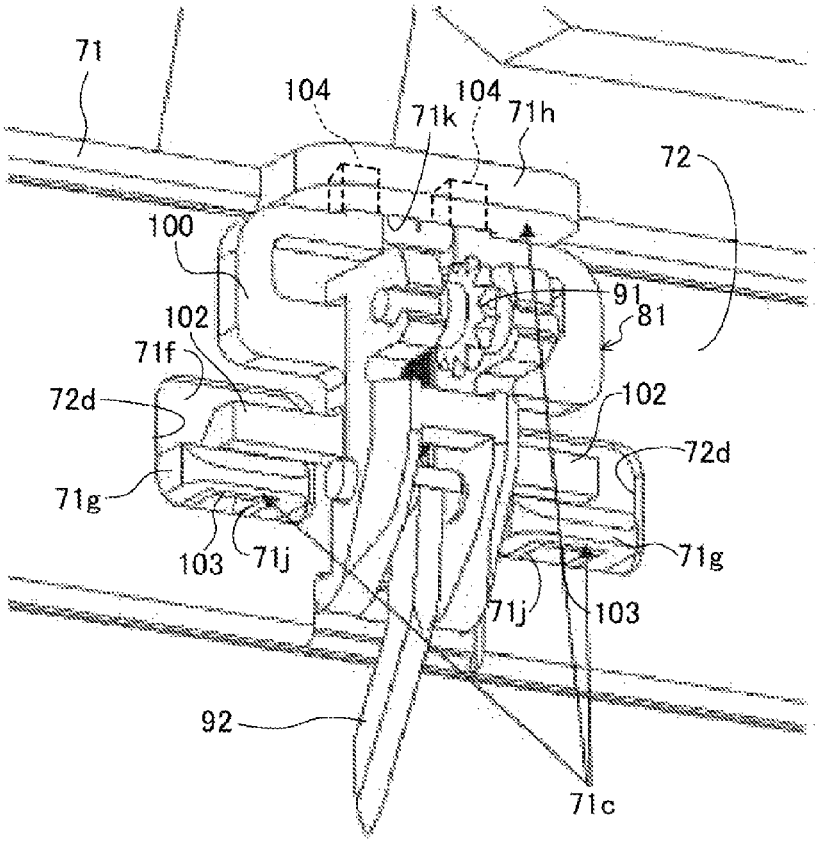
FIG. 15 perspectively illustrates a state where the first assembly is assembled to the first-assembly securing portion in the drum frame according to the first embodiment.

The following describes an assembly procedure of the paper separating device 31 to the drum frame 71 with reference to FIG. 13 to FIG. 15.

In the first step, two of the second assemblies 82 are prepared to be assembled to the second-assembly securing portions 72*a* of the securing plate 72 (in the step on the upmost side of FIG. 13). In this assembly work, firstly, the second engaging claws 104 (see FIG. 14) formed in the holder 100 are engaged with the securing-plate-side second engaging hole 72*k*. Subsequently, while the arm portions 102 of the holder 100 are pressed to the upper side with fingers and slightly bent, the first engaging claws 103 are inserted into the securing-plate-side first engaging holes 72*j*. Subsequently, when the fingers are separated from the arm portions 102, the arm portions 102 return to the original states by restoring force, and then the first engaging claws 103 are engaged with the securing-plate-side first engaging holes 72*j*. Thus, the assembly of the respective second assemblies 82 to the second-assembly securing portions 72*a* is completed.

In the next step, the securing plate 72 to which the second assemblies 82 are assembled is mounted on the securing-plate mounting surface 71*f* of the drum frame 71 (in the step in the middle of FIG. 13). When the securing plate 72 is mounted on the securing-plate mounting surface 71*f*, the frame-side first projecting portions 71*g* that constitute the first-assembly securing portion 71*c* pass through the insertion holes 72*d* formed in the securing plate 72 and then are exposed outside. Additionally, the frame-side second projecting portion 71*h* that constitutes the first-assembly securing portion 71*c* projects from the upper side with respect to the upper end edge of the securing plate 72, and then is exposed outside. That is, even after the securing plate 72 is secured to the securing-plate mounting surface 71*f* of the drum frame 71, the first-assembly securing portion 71*c* is exposed outside without being hidden by the securing plate 72.

In the last step, the first assembly 81 is assembled to the above-described exposed first-assembly securing portion 71*c* (in step on the downmost side of FIG. 13). In this assembly work, firstly, the second engaging claws 104 (see FIG. 15) formed in the holder 100 are engaged with the frame-side second engaging hole 71*k*. Subsequently, while the arm portions 102 of the holder 100 are pressed to the upper side with fingers and slightly bent, the first engaging claws 103 are inserted into the frame-side first engaging holes 71*j*. Subsequently, when the fingers are separated from the arm portions 102, the arm portions 102 return to the original states by restoring force, and then the first engaging claws 103 are engaged with the frame-side first engaging holes 71*j*. Thus, the assembly of the respective first assemblies 81 to the first-assembly securing portions 71*c* is completed. With the above-described three steps, the assembly of the paper separating device 31 to the drum frame is completed.

As described above, in the above-described embodiment, the paper separating device 31 includes the first assembly 81 that has both the paper separating function and the paper guiding function, and additionally includes the second assembly 82 that has the paper guiding function only. This can improve the conveyability (guiding performance) of the paper sheet P after being separated from the circumference surface of the photoreceptor drum 21 by the separation claw 92. Moreover, the above-described first and second assemblies 81 and 82 employ the same holders 100. This can commonalize components, thus reducing the product cost.

In the above-described embodiment, the second-assembly securing portion 72*a* for securing the second assembly 82 is formed not in the drum frame 71 but in the securing plate 72. This can separate the assembly step (in the step on the upmost side of FIG. 13) of the second assembly 82 and the assembly step (in step on the downmost side of FIG. 13) of the first assembly 81 into different steps. This can prevent the error in which the first assembly 81 is erroneously assembled to the second-assembly securing portion 72*a* or the second assembly 82 is erroneously assembled to the first-assembly securing portion 71*c*.

In the above-described embodiment, the second-assembly securing portion 72*a* is formed in the securing plate 72 for securing the sealing member 73. This can suppress the increase in the number of components using the existing securing plate 72. This can reduce the product cost.

Second Embodiment

Figure 17:
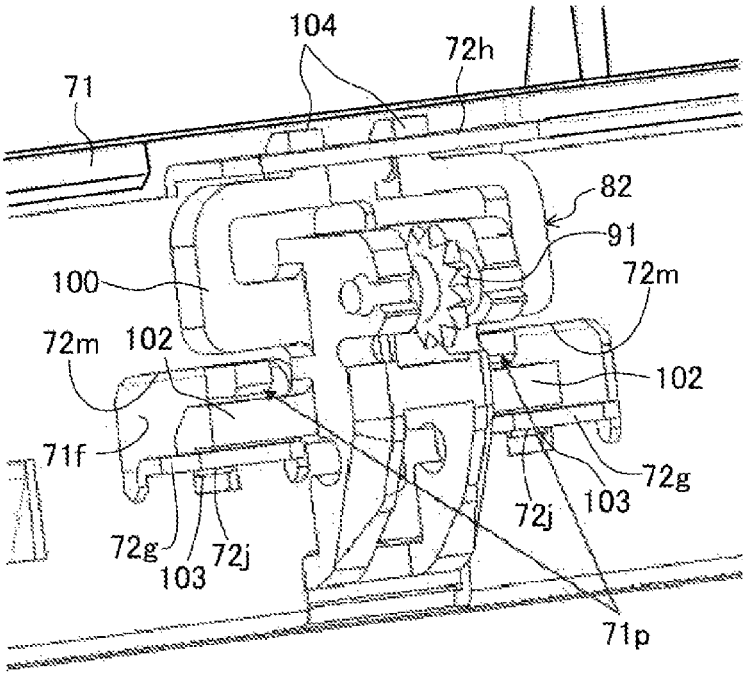
FIG. 17 perspectively illustrates a state where a second assembly is assembled to a drum unit according to a second embodiment.

FIG. 17 illustrates a second embodiment. This second embodiment is different from the above-described first embodiment in configuration of the securing-plate mounting surface 71*f* of the drum frame 71. In the following embodiment, like reference numerals designate corresponding or identical elements throughout FIG. 15 and FIG. 17, and therefore such elements will not be further elaborated here.

That is, in this embodiment, on the securing-plate mounting surface 71*f* of the drum frame 71, a pair of regulating portions 71*p* is formed. The pair of regulating portions 71*p* regulates the displacement of the first engaging claws 103, which is formed in the holder 100 of the second assembly 82, toward the engagement releasing side. The respective regulating portions 71*p* are formed to project to the inside of the pair of through-holes 72*m* formed in the securing plate 72. The regulating portions 71*p* are each arranged adjacent to the arm portion 102 of the holder 100 at the upper side within the through-hole 72*m*. Accordingly, this regulating portion 71*p* regulates the upward displacement of the arm portion 102. Thus, the regulating portion 71*p* regulates the displacement of the engaging claw 103 to the upper side (that is, the engagement releasing side). This can prevent the second assembly 82 once assembled to the second-assembly securing portion 72*a* from being carelessly removed. Thus, this can reliably prevent the first assembly 81 from being erroneously assembled to the second-assembly securing portion 72*a*.

Third Embodiment

In the above-described embodiments, the examples where the paper separating device 31 is applied to the photoreceptor drum 21 have been described. This, however, should not be construed in a limiting sense. For example, the paper separating device 31 may be applied to the fixing roller (fixing drum) 40*a* for heat fixing of toner to a paper sheet. In the above-described embodiments, the second assembly 82 is secured to the securing plate 72 and the first assembly 81 is secured to the drum frame 71. This, however, should not be construed in a limiting sense. The first assembly 81 may be secured to the securing plate 72 and the second assembly 82 may be secured to the drum frame 71.

While in the above-described embodiments the copier 1 has been described as one example of the image forming apparatus, the image forming apparatus according to the disclosure is not limited to this. For example, another image forming apparatus such as a printer, a scanner device, or a multi-functional peripheral is possible.

As described above, the disclosure is effective for an electrophotographic system image forming apparatus with a photoreceptor drum, in particular, effective for an image forming apparatus with separating unit for separating a paper sheet from a photoreceptor drum.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A paper separating device comprising:

a frame member;

a rotating image carrier supported by the frame member for rotationally abutting contact on paper sheets;

assemblies, the assemblies being of two types, a first assembly type including a separation claw configured to separate paper sheets from the image carrier, a guiding member configured to guide paper sheets in being separated from the image carrier by the separation claw, and a holder holding the separation claw and the guiding member, the holder a having first and second engaging claws, and a second assembly type including a duplicate of the guiding member of the first assembly type, and a duplicate of the holder of the first assembly type, but absent the separation claw of the first assembly type; and an assembly-securing plate removably mounted on a mounting surface of the frame member, the securing plate having disposed thereon securing-plate-side assembly securing portions each including a securing-plate-side first projecting portion and a securing-plate-side second projecting portion projecting from the securing plate and are spaced apart from each other, securing-plate-side first engagement holes formed in the securing-plate-side first projecting portion as engagement portions for being engaged with the first engaging claws of the holder of either the first assembly type or the second assembly type, and securing-plate-side second engagement holes formed in the securing-plate-side second projecting portion as engagement portions for being engaged with the second engaging claws of the holder of the first assembly type or of the second assembly type; wherein the frame member includes, disposed on the securing-plate mounting surface of the frame member, frame-side assembly securing portions each with engagement portions for being engaged with the first and second engaging claws of the holder of either the first assembly type or of the second assembly type, and regulating portions, the regulating portions being configured to restrict engagement-releasing displacement of the first engaging claws of the holder of either the first assembly type or of the second assembly type; and the assemblies of one of the two types are secured to the securing-plate-side assembly securing portions, while the assemblies of the other of the two types are secured to the frame-side assembly securing portions.

2. The paper separating device according to claim 1, wherein the assemblies of the second type are secured to the securing-plate-side assembly securing portions, while the assemblies of the first type are secured to the frame-side assembly securing portions.

3. An image forming apparatus, comprising:

the paper separating device according to claim 1; wherein the image carrier is a photoreceptor drum.

4. A paper separating device comprising:

a frame member;

a rotating image carrier supported by the frame member for rotationally abutting contact on paper sheets;

assemblies, the assemblies being of two types, a first assembly type including a separation claw configured to separate paper sheets from the image carrier, a guiding member configured to guide paper sheets in being separated from the image carrier by the separation claw, and a holder holding the separation claw and the guiding member, the holder having first and second engaging claws, and a second assembly type including a duplicate of the guiding member of the first assembly type, and a duplicate of the holder of the first assembly type, but absent the separation claw of the first assembly type; and an assembly-securing plate removably mounted on a mounting surface of the frame member, the securing plate having disposed thereon securing-plate-side assembly securing portions each with engagement portions for being engaged with the first and second engaging claws of the holder of either the first assembly type or of the second assembly type; wherein disposed on the securing-plate mounting surface of the frame member are frame-side assembly securing portions each including a frame-side first projecting portion and a frame-side second projecting portion projecting from the frame member and spaced apart from each other, frame-side first engagement holes formed in the frame-side first projecting portion as engagement portions for being engaged with the first engaging claws of the holder of either the first assembly type or the second assembly type, and frame-side second engagement holes formed in the frame-side second projecting portion as engagement portions for being engaged with the second engaging claws of the holder of the first assembly type or of the second assembly type, and engaging-claw regulating portions, the regulating portions being configured to restrict engagement-releasing displacement of the first engaging claws of the holder of either the first assembly type or of the second assembly type; and the assemblies of one of the two types are secured to the securing-plate-side assembly securing portions, while the assemblies of the other of the two types are secured to the frame-side assembly securing portions.

5. The paper separating device according to claim 4, wherein the securing-plate-side assembly securing portions each include:

a securing-plate-side first projecting portion and a securing-plate-side second projecting portion projecting from the securing plate and spaced apart from each other;

securing-plate-side first engagement holes formed in the securing-plate-side first projecting portion as the engagement portions for being engaged with the first engaging claws of the holder of either the first assembly type or the second assembly type; and securing-plate-side second engagement holes formed in the securing-plate-side second projecting portion as the engagement portions for being engaged with the second engaging claws of the holder of the first assembly type or of the second assembly type.

6. The paper separating device according to claim 4, wherein the assemblies of the second type are secured to the securing-plate-side assembly securing portions, while the assemblies of the first type are secured to the frame-side assembly securing portions.

7. An image forming apparatus, comprising:

the paper separating device according to claim 4; wherein the image carrier is a photoreceptor drum.

8. The paper separating device according to claim 5, wherein the assemblies of the second type are secured to the securing-plate-side assembly securing portions, while the assemblies of the first type are secured to the frame-side assembly securing portions.

9. An image forming apparatus, comprising:

the paper separating device according to claim 5; wherein the image carrier is a photoreceptor drum.

* * * * *